United States Patent [19]

Krumm et al.

[11] 4,360,939

[45] Nov. 30, 1982

[54] FLOOR CARE DEVICE

[75] Inventors: Heinz-Gerhard Krumm; Peter Wulf, both of Ennepetal; Wieland Gühne, Remscheid, all of Fed. Rep. of Germany

[73] Assignee: Vorwerk & Co. Interholding GmbH, Wuppertal, Fed. Rep. of Germany

[21] Appl. No.: 205,974

[22] Filed: Nov. 12, 1980

[30] Foreign Application Priority Data

Nov. 20, 1979 [DE] Fed. Rep. of Germany ..... 2946732

[51] Int. Cl.[3] ..... A47L 71/18

[52] U.S. Cl. ..... 15/49 C; 15/41 R; 15/79 A

[58] Field of Search ..... 15/49 C, 50 C, 79 A, 15/82, 83, 383, 389, 41 R; 51/176

[56] References Cited

U.S. PATENT DOCUMENTS

| | | | |
|---|---|---|---|
| 893,488 | 7/1908 | Hall | 15/49 C |
| 959,721 | 5/1910 | Cummings | 15/49 C |
| 1,826,801 | 10/1931 | Littleford, Jr. | 15/49 C X |
| 2,298,054 | 10/1942 | Howell | 15/79 A X |
| 3,113,332 | 12/1963 | Kasper | 15/82 |

*Primary Examiner*—Edward L. Roberts

*Attorney, Agent, or Firm*—Michael J. Striker

[57] ABSTRACT

A floor care device has a rotary tool rotatable about an axis of rotation, a motor arranged to drive the rotary tool in rotation through a power transmission, and a supporting element formed as an angle lever which supports the tool, the motor and the power transmission and freely turns about a pivot axis which is offset relative to the axis of rotation of the tool in a substantially upright direction.

7 Claims, 5 Drawing Figures

FLOOR CARE DEVICE

BACKGROUND OF THE INVENTION

The present invention relates to a floor care device. More particularly, it relates to a floor care device which has a working tool and an electric motor which drives the working tool in rotation via a transmission.

Floor care devices which are provided with working tools operating from electric motors are known in the art. One of such devices is disclosed for example in the German Offenlegungsschrift 2,902,232. This floor care device is provided with a rocking means which is turnably mounted in the base housing. By the selection of the pivot point, the working tool is loaded toward the floor to be cared for by a driving pulley or its pulling force. In other words, the working tool is always pressed against the floor or the like to be cared for with a fixed force. Abutment on the rocking means prevents turning in an upward direction. The above-described construction has the following considerable disadvantages. When the working tool becomes arrested because of the hindrance or the structure of the surface to be worked, and when insignificant torque increase takes place, the drive pulley breaks or the drive motor is considerably loaded which can lead to breakage. These disadvantages can be avoided only by the provision of very expensive friction clutches.

SUMMARY OF THE INVENTION

Accordingly, it is an object of the present invention to provide a floor care device which avoids the disadvantages of the prior art.

More particularly, it is an object of the present invention to provide a floor care device in which the electric motor together with the transmission is protected against breakage in a very simple manner in conditions of loading of the working tool, and the output of the electric motor is maintained constant.

In keeping with these objects and with others which will become apparent hereinafter, one feature of the present invention resides, briefly stated, in a floor care device including a tool, a motor, and a power transmitting element between the tool and the motor, wherein the tool, the motor and the power transmitting element are supported on an angle lever freely turnable about a pivot axis which is offset relative to an axis of rotation of the tool in a substantially upright direction. The pivot axis of the angle lever may be offset upwardly or downwardly from the axis of rotation of the tool, in dependence upon the direction of rotation of the working tool.

Another feature of the present invention is that two housing parts may be provided of which one housing part is arranged to run over a floor or the like to be cared for, whereas the other housing part forms the above-mentioned angle lever and is freely turnably mounted on the first-mentioned housing part.

In accordance with a further feature of the present invention, only one housing part arranged to run over a floor or the like to be cared for is provided, and the angle lever is turnably mounted on this housing part. In the first-mentioned construction the working tool extends through an opening provided in the second turnable housing part, whereas in the second construction the working tool extends through an opening provided in the first running housing part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
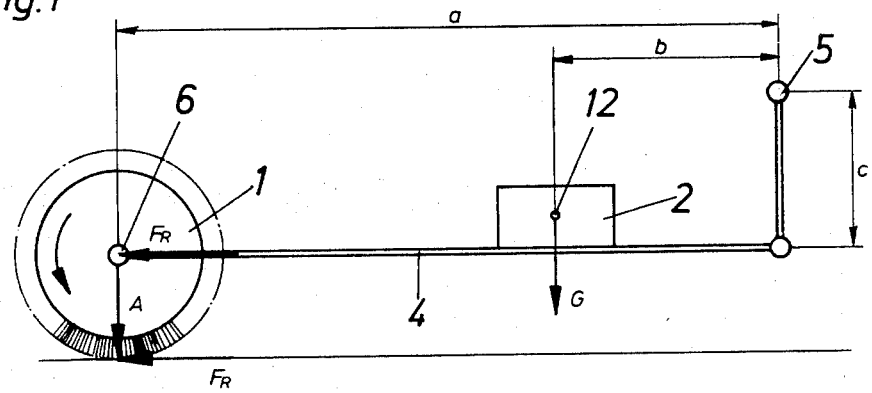
FIG. 1 is a view which schematically shows a floor care device in accordance with the present invention and the distribution of forces in the same.

FIG. 1 shows a theoretical construction of a floor care device in accordance with the present invention, and the distribution of forces in the same. The floor care device has a working tool 1 for working a floor or the like, for example for cleaning the floor. The working tool 1 is driven for rotation about an axis 6 by an electric motor 2.

An angle lever 4 is provided in the floor care device of the invention. The angle lever 4 is freely turnable about a pivot axis 5. The tool 1 is supported on the angle lever 4. The electric motor 2 is also supported on the angle lever 4 and has a center of gravity identified by reference numeral 12. The center of gravity 12 of the electric motor 2 has an arm b from the pivot axis 5 of the angle lever 4. A certain loading force A is applied through the working tool 1 in the axis of rotation 6 via an arm a.

The loading force A is always constant in the event when the arms a, b are constant and the weight G of the electric motor 2 is also constant. This is true for static condition of the device.

However, when the working tool 1 rotates in direction identified by the arrow, a friction force $F_R$ is generated. This friction force corresponds to the following equation:

$$F_R = A \times \mu.$$

It can be seen from this equation that when the loading force A is constant and the friction coefficient $\mu$ varies, the friction force $F_R$ varies in dependence upon the friction coefficient $\mu$. When greater floor height or higher loading increases the friction coefficient $\mu$, the friction force $F_R$ also increases. This, in turn, increases a torque on a lever c and acts opposite to the loading force A. In other words, the angle lever 4 will turn the working tool 1 so that the latter turns from the carpet which is not shown in the drawing. Thereby, the loading force A decreases and the friction force $F_R$ becomes smaller.

As can be understood from the above description, the floor care machine is thereby provided with a control which influences the torque on the working tool 1 and at the same time does not affect constancy of the output of the electric motor 2. The output of the electric motor 2 remains constant within certain limits.

Figure 1A:
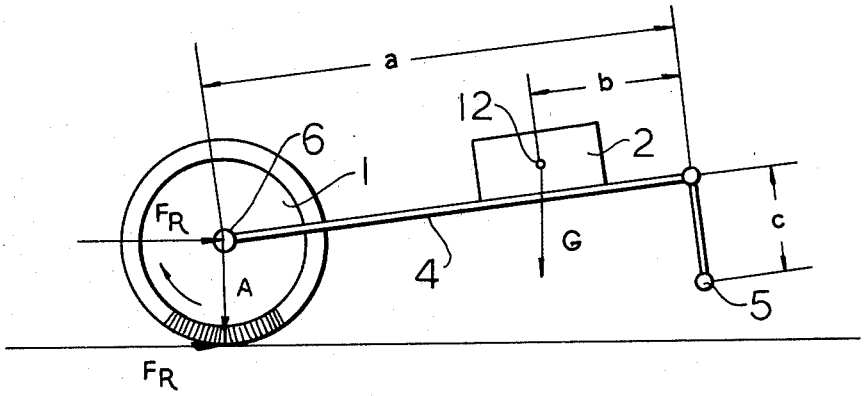
FIG. 1*a* is a view substantially corresponding to that of FIG. 1 but showing the floor care device in accordance with another embodiment of the invention.

When the working tool rotates in the opposite direction, the angle lever 4 must be arranged oppositely. The pivot point 5 of the angle lever 4 must be located below the axis of rotation 6 of the working tool, in order to attain the above-mentioned result. This construction is shown in FIG. 1*a* of the drawings. In other words, when the working tool rotates in counterclockwise direction as shown in FIG. 1, the pivot point 5 of the angle lever 4 must be located above the axis of rotation 6 of the working tool 1. In contrast, when the working tool rotates in clockwise direction as shown in FIG. 1*a*, the pivot point 5 of the angle lever 4 must be located below the axis of rotation 6 of the working tool 1.

Figure 2:
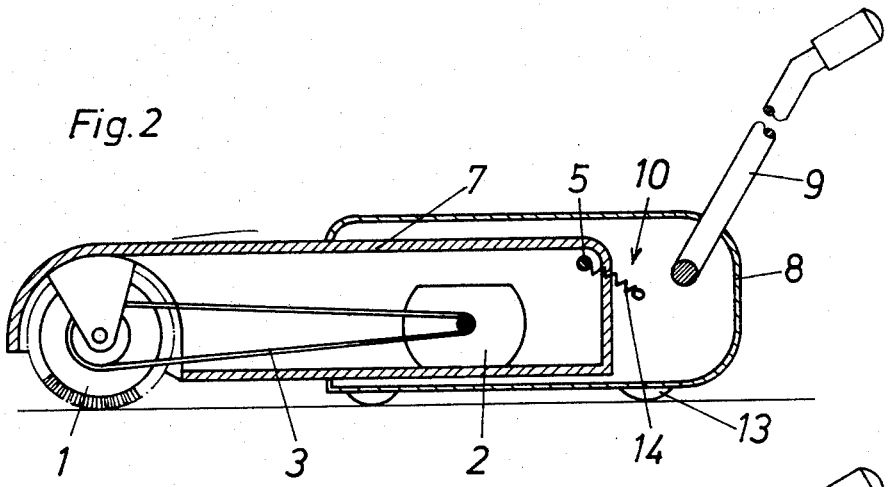
FIG. 2 is a view schematically showing a section of the floor care device in accordance with one embodiment of the invention.
Figure 3:
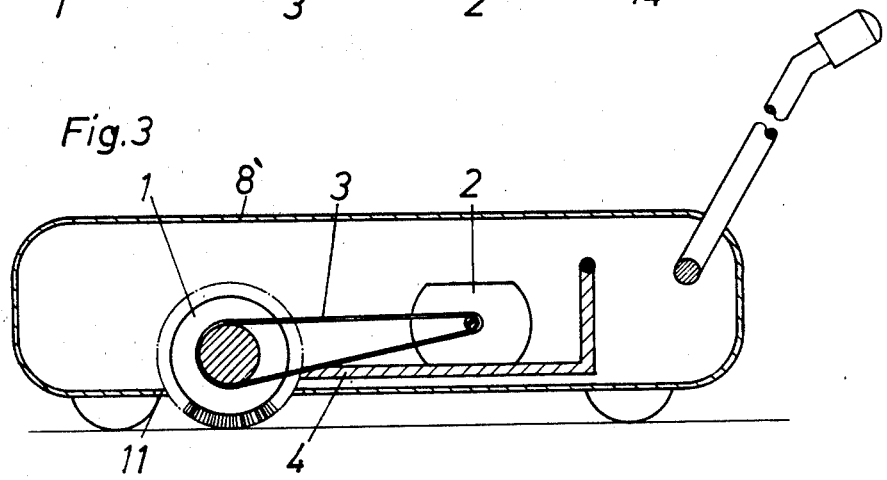
FIG. 3 is a view schematically showing the floor care device in accordance with still a further embodiment of the invention.
Figure 2A:
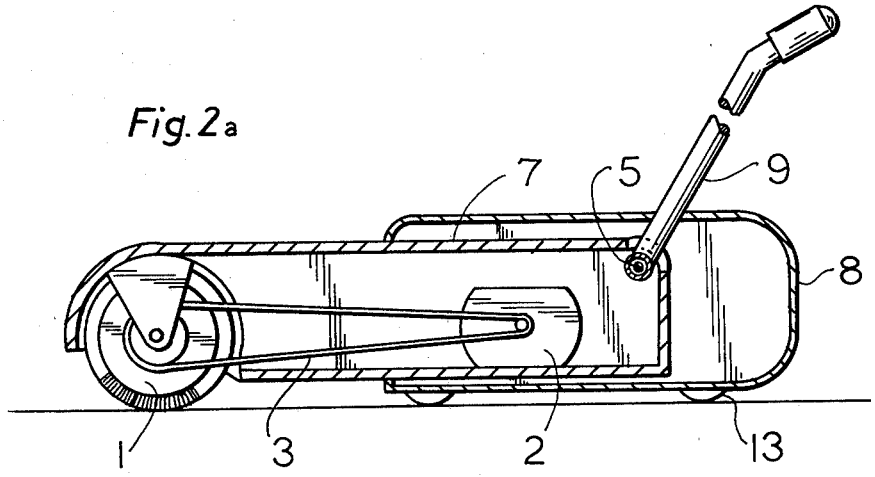
FIG. 2*a* is a view substantially corresponding to that of FIG. 2 but showing a further embodiment of the invention.

FIGS. 2*a* and 3 show constructions of the floor care device in accordance with the present invention. The construction shown in FIG. 2 has a base housing 8 which is provided with a guide handle 9 and guiding members or runners 13. The base housing 8 is substantially closed. A housing part 7 is turnably mounted on the base housing 8 so as to turn about the above-mentioned pivot axis 5. The latter can be defined by an axle. The electric motor 2, the working tool 1, and a transmission unit 3 arranged therebetween for transmitting the rotation from the electric motor 2 to the working tool 1, are supported in the housing part 7. The housing part 7 thereby performs the functions of the angle lever 4 shown in FIG. 1.

An oscillation damping means identified by reference numeral 10 is further provided. The oscillation damping means 10 is arranged between the base housing 8 and the housing part 7. This oscillation damping means can prevent strong jumps of the housing part 7. The oscillation damping means 10 can be formed by a simple pulling spring 14 which loads the turning connection of the housing elements 7 and 8 by its pulling force.

The guiding handle 9 is attached to the base housing 8. The guiding handle 9 can be connected in the pivot axis 5 which is shown in FIG. 2*a* of the drawings. This provides for favorable transmission of the displacement force to the floor care device.

FIG. 3 shows the floor care device which is substantially similar to that shown in FIG. 2 but has some distinctive features. The base housing 8' of the floor care device of FIG. 3 is closed. In the floor care machine shown in FIG. 2, the turnable housing part 7 is provided with an opening through which the working tool 1 extends outwardly toward the floor or the like to be treated. In contrast, in the floor care device shown in FIG. 3, the base housing 8' is provided with an opening 11 through which the working tool 1 extends outwardly. Here, the angle lever 4 is designed as a conventional angle lever and turnably mounted in the base housing 8'.

It will be understood that each of the elements described above, or two or more together, may also find a useful application in other types of constructions differing from the types described above.

While the invention has been illustrated and described as embodied in a floor care device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A floor care device, comprising a rotary tool rotatable about an axis of rotation; a motor arranged to drive said rotary tool in rotation; power-transmitting element between said motor and said rotary tool; supporting means including an angle lever which supports said tool, said motor and said power-transmitting element freely turning about a pivot point which is offset relative to said axis of rotation of said tool in a substantially vertical direction, said supporting means including a first part formed as a first housing which is arranged to run over a floor or the like, and a second part forming said angle lever and formed as a second housing which has one portion located inside and another portion located outside said first housing and is freely turnable about said pivot point; and a guiding handle arranged to transport the floor care device, said guiding handle being mounted on said first housing and connected with the latter in said pivot point.

2. A floor care device as defined in claim 1, wherein said tool is arranged rotatable in counterclockwise direction, said pivot axis of said angle lever being offset upwardly from said axis of rotation of said rotary tool.

3. A floor care device as defined in claim 1, wherein said tool is arranged rotatable in clockwise direction, said pivot axis of said angle lever being offset downwardly from said axis of rotation of said rotary tool.

4. A floor care device as defined in claim 1, wherein said motor is an electric motor.

5. A floor care device as defined in claim 1; and further comprising oscillation-absorbing means arranged between said first housing and said second housing.

6. A floor care device as defined in claim 1, wherein said first housing has an opening through which said second housing extends and is substantially closed with the exception of said opening, with a further opening through which said rotary tool at least partially extends toward a floor or the like to be cared for, said second housing being substantially closed with the exception of said further opening.

7. A floor care device as defined in claim 6, wherein said first-mentioned opening of said first housing has an axis extending substantially in a horizontal direction, whereas said further opening of said second housing has an axis extending substantially in a vertical direction.

* * * * *